United States Patent [19]

Bollman

[11] 4,111,540

[45] Sep. 5, 1978

[54] FIELD LENS FOR AN ELECTROPHOTOGRAPHIC PRINTING MACHINE

[75] Inventor: James E. Bollman, Williamson, N.Y.

[73] Assignee: Xerox Corporation, Stamford, Conn.

[21] Appl. No.: 687,562

[22] Filed: May 17, 1976

[51] Int. Cl.[2] ..... G03G 15/01

[52] U.S. Cl. ..... 355/4; 355/75

[58] Field of Search ..... 355/3 R, 4, 11, 75, 355/76; 248/44

[56] References Cited

U.S. PATENT DOCUMENTS

| | | | |
|---|---|---|---|
| 3,439,983 | 4/1969 | Blow | 355/11 X |
| 3,813,161 | 5/1974 | Curtis | 355/76 X |
| 3,936,173 | 2/1976 | Kidd et al. | 355/4 X |
| 4,027,962 | 6/1977 | Mailloux | 355/4 |

*Primary Examiner*—Richard L. Moses

*Attorney, Agent, or Firm*—J. J. Ralabate; C. A. Green; H. Fleischer

[57] ABSTRACT

An electrophotographic printing machine in which the platen thereof is a field lens. In the opaque reproduction mode, the original document is positioned on the platen in a light receiving relationship with the illumination system. The presence of the field lens does not interfere with the opaque copying mode of the printing machine. When a transparency is being reproduced, the light image of the transparency is projected through the platen. The field lens converges the diverging light rays of the transparency light image.

16 Claims, 3 Drawing Figures

FIELD LENS FOR AN ELECTROPHOTOGRAPHIC PRINTING MACHINE

BACKGROUND OF THE INVENTION

This invention relates generally to an electrophographic printing machine, and more particularly concerns a platen for use therein:

Generally, electrophotographic printing machines are provided with a transparent platen upon which the original document is supported. An optical image of the original document is created and recorded as an electrostatic latent image upon a photoconductive surface. The machine is usually provided with a cover to prevent extraneous light from entering the optical system during the imaging process. Typically, the cover has a rigid outer shell with a suitable light weight rubber material adhering thereto and arranged to engage the original document disposed on the platen. The rubber material is flexible and colored white to reflect light rays therefrom. U.S. Pat. No. 3,642,371 issued to Jones et al. in 1972, disclosed a platen cover having a white reflective surface.

The basic operation of an electrophotographic printing machine is well known and this concept has been employed in a wide variety of products. Various special purpose types of electrophotographic printing machines have been developed and are in wide commercial use. For example, electrophotographic printing machines which employ a field lens have been developed for reproducing microfilm. Machines of this type are described in U.S. Pat. No. 3,424,525 issued to Towers et al. in 1969; U.S. Pat. No. 3,542,468 issued to Blow, Jr. in 1970; and U.S. Pat. No. 3,547,533 issued to Stokes et al. in 1970. In general, a microfilm reproducing machine produces an enlarged copy of a microfilm original. However, it has been found that it is frequently difficult to produce copies having pictorial quality. Only recently have electrophotographic printing machines been developed which have the capability of reproducing slides as pictorial quality copies. A machine of this type is described in co-pending application Ser. No. 540,617 filed in 1975, now U.S. Pat. No. 4,027,962, issued to Mailloux in 1977. As described therein, a light image of a transparency is projected onto a mirror. The mirror reflects the light image through a screen and field lens onto the charged portion of the photoconductive surface. The screen and field lens are disposed on the platen of the electrophotographic printing machine. Generally, the platen is a planar transparent glass member. The light image transmitted through the platen irradiates the charged photoconductive surface. In this manner, an electrostatic latent image is recorded on the photoconductive surface and developed with toner particles. The toner powder images are transferred to a sheet of support material and then permanently affixed thereto forming a copy of the slide being reproduced.

In reproducing slides, both the screen and field lens are disposed on the transparent platen. Contrawise, in reproducing opaque original documents, only the original document is disposed on the transparent platen with both the screen and field lens being removed therefrom. This introduces additional manipulations and frequently results in the loss of either the screen or field lens. It would appear to be highly desirable to integrate the field lens with the structure of the electrophotographic printing machine to eliminate the requirement of moving the field lens into and out of the optical light path depending upon the type of original document being reproduced.

Accordingly, it is a primary object of the present invention to improve the platen structure of an electrophotographic printing machine to reproduce transparencies and opaque documents thereon.

SUMMARY OF THE INVENTION

Briefly stated, and in accordance with the present invention, there is provided an apparatus for holding an original document.

Pursuant to the features of the present invention, the apparatus includes a substantially rigid frame member having an aperture therein. A field lens is mounted in the aperture of the frame.

It is contemplated that the apparatus of the present invention may be employed in an electrophotographic printing machine arranged to reproduce opaque and transparent original documents. When an opaque original document is being reproduced, the field lens supports the original document in the light receiving relationship with the illumination system. Contrawise, in reproducing a transparency, a light image of the transparency is projected through the field lens.

BRIEF DESCRIPTION OF THE DRAWINGS

Other objects and advantages of the present invention will become apparent upon reading the following detailed description and upon reference to the drawings, in which.

Figure 1:
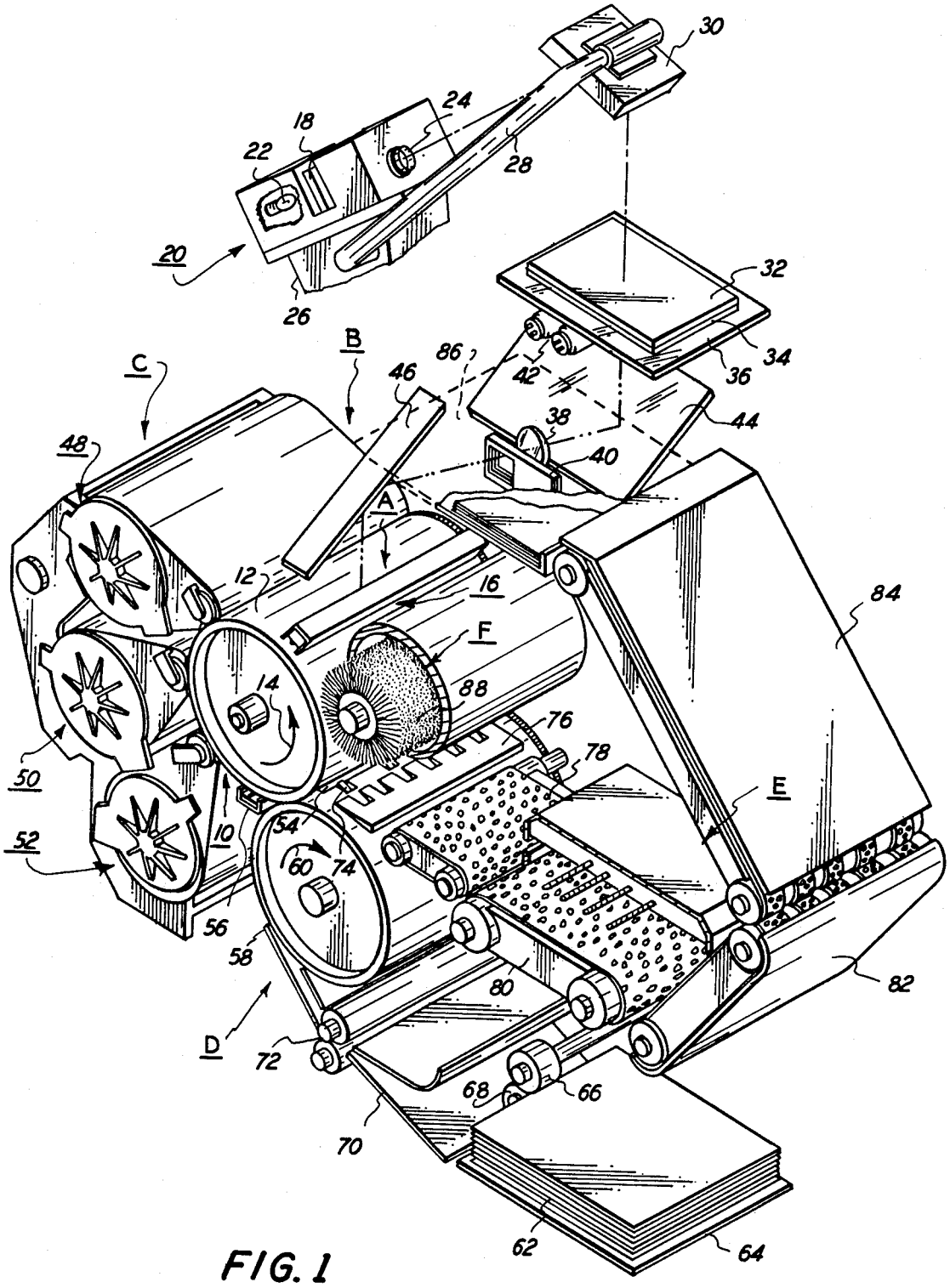
FIG. 1 is a schematic perspective view of an electrophotographic printing machine incorporating the features of the present invention therein.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the present invention as defined by the appended claims.

DETAILED DESCRIPTION

For a general understanding of an electrophotographic printing machine incorporating the features of the present invention therein, continued reference is had to the drawings. In the drawings, like reference numerals have been used throughout to designate identical elements. Although the electrophotographic printing machine of the present invention is particularly well adapted for reproducing color transparencies, it should become evident from the following discussion that it is equally well suited for use in a wide variety of applications such as producing color copies from opaque original documents, black and white copies from black and white transparencies, or black and white copies from black and white opaque original documents, and is not necessarily limited to the particular embodiment shown herein.

An illustrative schematic of the electrophotographic printing machine is shown in FIG. 1. As depicted therein, the electrophotographic printing machine employs a photoconductive member having a drum 10 mounted rotatably within the machine frame (not shown) with photoconductive surface 12 secured thereto and entrained thereabout. Preferably, photoconductive surface 12 is made from a suitable panchromatic selenium alloy such as is described in U.S. Pat. No. 3,655,377 issued to Sechak in 1972.

As drum 10 rotates in the direction of arrow 14, photoconductive surface 12 passes through a series of processing stations located about the periphery thereof. Drum 10 is rotated at a constant angular velocity so that the proper sequencing of events may occur at each of the processing stations. Timing for each event is achieved by a signal generator (not shown) operatively associated with drum 10. The signal generator develops electrical pulses which are processed by the machine logic so that each processing station is activated at the appropriate time during the rotation of drum 10.

Initially, drum 10 rotates a portion of photoconductive surface 12 through charging station A. At charging station A, a corona generating device, indicated generally by the reference numeral 16, charges the portion of photoconductive surface 12 passing therethrough to a relatively, high substantially uniform level. A suitable corona generating device is described in U.S. Pat. No. 3,875,407 issued to Hayne in 1975.

After photoconductive surface 12 is charged to a substantially uniform level, drum 10 rotates the charged portion thereof to exposure station B. At exposure station B, a color filtered light image of color transparency 18, as exemplified by a 35 mm slide, is projected onto the charged portion of photoconductive surface 12. Color transparency 18 is positioned in slide projector 20. Slide projector 20 includes a light source 22 adapted to illuminate transparency 18. In addition, slide projector 20 comprises a lens 24 having an adjustable focus to produce an enlarged or magnified image of color transparency 18. Slide projector 20 is mounted on a portion of the printing machine frame, designated by the reference numeral 26. A bar 28 has one end portion thereof mounted pivotably on frame 26. The other end portion of bar 28 is secured rotatably to mirror 30. In this manner, bar 28 may be pivoted relative to frame 26 to move mirror 30 out of the path of the transparency light image when an opaque original document is being reproduced by the electrophotographic printing machine. When a transparency is being reproduced, bar 28 is pivoted to position mirror 30 in the path of the transparency light image. Thus, the light image of transparency 18, projected from slide projector 20, is transmitted to mirror 30 which directs it through screen 32 and composition frame 34. Composition frame 34 is interposed between screen 32 and platen 36. Platen 36 is a field lens, i.e., a Fresnel lens, adapted to converge the diverging light rays of the transparency so that the resultant light rays are directed into lens 38. Composition frame 34 is an opaque sheet having an aperture therein, i.e., a picture frame or informational frame, defining an opaque border extending outwardly from the color transparency image. Indicia may be inscribed on frame 34. Screen 32 modulates the color transparency light image forming a half-tone light image. A scanning system is disposed beneath platen 36 and includes a moving lens system designated generally by the reference numeral 38, and a color filter mechanism, shown generally at 40. Lamps 42 move in a timed relationship with lens 38 and filter mechanism 40 to illuminate and scan successive incremental areas of composition frame 34 which may be optionally placed on platen 36. In this manner, a half-tone light image of the color transparency may be combined with the light image of the composition frame to form a combined image. This combined image is transmitted onto the charged portion of photoconductive surface 12 selectively dissipating the charge thereon to record an electrostatic latent image.

The platen cover must be pivoted to the opened position permitting arm 28 to pivot locating mirror 30 in the path of the transparency light image. When an opaque original document is being reproduced, arm 28 pivots mirror 30 to a position remote from the path of the transparency light image enabling the platen cover to be closed. In the opaque reproduction mode, composition frame 34 and screen 32 are removed from platen 36 and the original document (not shown) is disposed on platen 36. Thus, platen 36, which is a field lens, is employed for the reproduction of the transparency and the opaque original document.

Preferably, projector 20 is a Kodak Carousel 600 slide projector having an F/3.5 Ektaner C projection lens. Light source 22 is a quartz lamp. Projector 20 is mounted on frame 26 of the printing machine.

Screen 32 includes preferably a substantially transparent sheet having a plurality of spaced, opaque dots thereon. The spacing between adjacent dots determines the quality of the resultant copy. By way of example, a dot screen having about 85 equally spaced, soft gray square dots per inch is disposed on platen 36. However, this may range from about 65 to about 300 dots per inch. The foregoing is only limited by the optical system and the desired resolution. A suitable dot screen for disposition on platen 36 is manufactured by Caprock Corporation and may be a negative screen. An optical system employing such a screen for reproducing transparencies is described in co-pending application Ser. No. 540,617 filed in 1975.

Lamps 42 traverse platen 36 to illuminate incremental areas of composition frame 34. In this way, the light rays from composition 34 and modulated light image of the transparency are transmitted onto mirror 44. Mirror 44 reflects the combined light image through lens 38. Preferably, lens 38 is a six-element split dagor type of lens having front and back compound lens components with a centrally located diaphragm therebetween. Lens 38 forms a high quality image with a field angle of about 31° and a speed ranging from about F/4.5 to about F/8.5 at a 1:1 magnification. In addition, lens 38 is designed to minimize the effect of secondary color in the image plane. The front lens component has three lens elements including, in the following order, a first lens element of positive power, a second lens element of negative power cemented to the first lens element and a third lens element of positive power disposed between the second lens element and the diaphragm. The back lens component also has three similar lens elements positioned so that lens 38 is symmetrical. Specifically, the first lens element, in the first component, is a double convex lens, the second element a double concave lens, and the third element a convex-concave lens element. For greater details regarding lens 38, reference is made to U.S. Pat. No. 3,592,531 issued to McCrobie in 1971.

The light image transmitted by lens 38 passes through one of the filters in filter mechanism 40. Preferably, filter mechanism 40 includes a housing which is mounted on lens 38 by a suitable bracket and moves with lens 38 during scanning as a single unit. The housing of filter 40 includes a window which is positioned relative to lens 38 permitting the light rays of the combined image, i.e., that of the composition frame and transparency to pass therethrough. Part of the top walls of the housing include a plurality of tracks which extend the entire width thereof. Each track is adapted to carry a filter to permit movement thereof from an inoperative position to an operative position. In the operative position, the filter is interposed in the window of the housing permitting light rays to pass therethrough. Individual filters are made from any suitable filter material such as coated glass. Preferably, three filters are employed in the electrophotographic printing machine depicted in FIG. 1, a red filter, a blue filter, and a green filter. A detailed description of the filter mechanism may be found in U.S. Pat. No. 3,775,006 issued to Hartman et al. in 1973.

As previously noted, lamps 42, lens 38, and filter 40 move in synchronism with the rotation of drum 10. The light image transmitted therethrough is reflected by mirror 46 onto the charged portion of photoconductive surface 12. This selectively dissipates the charge thereon to record a single color electrostatic latent image. This single color electrostatic latent image may comprise a modulated electrostatic latent image of the transparency as well as an un-modulated electrostatic latent image of the composition frame. In the alternative, an opaque original document may be disposed on platen 36. In this mode of operation, an un-modulated electrostatic latent image is recorded on photoconductive surface 12. Moreover, projector 20 no longer projects a light image of the transparency through platen 36 when an original document is positioned thereon.

With continued reference to FIG. 1, after the electrostatic latent image is recorded on photoconductive surface 12, drum 10 rotates to development station C. At development station C, three individual developer units, generally indicated by the reference numerals 48, 50 and 52, respectively, are arranged to render visible the electrostatic latent image recorded on photoconductive surface 12. Preferably, each of the developer units are of the type generally referred to in the art as "magnetic brush developer units". A typical magnetic brush developer unit employs a magnetizable developer mix which includes carrier granules and heat settable toner particles. In operation, the developer mix is continually brought through a directional flux field forming a chain-like array of fibers extending outwardly from the developer unit. This chain-like array of fibers is frequently termed a brush. The electrostatic latent image, recorded on photoconductive surface 12, is rotated into contact with the brush of developer mix. Toner particles are attracted from the carrier granules to the latent image. Each of the developer units contain appropriately colored toner particles. For example, a green filtered light image is developed by depositing magenta toner particles thereon. Similarly, a red filtered light image is developed with cyan toner particles and a blue filtered light image with yellow toner particles. A development system of this type is described in U.S. Pat. No. 3,854,449 issued to Davidson in 1974.

After the single color electrostatic latent image is developed, drum 10 rotates to transfer station D. At transfer station D, the toner powder image adhering electrostatically to photoconductive surface 12 is transferred to a sheet of support material 54. Support material 54 may be a sheet of paper or a sheet of plastic material, amongst others. Transfer station D includes a corona generating means, indicated generally by the reference numeral 56, and a transfer roll designated generally by the reference numeral 58. Corona generator 56 is excited with an alternating current and arranged to pre-condition the toner powder image adhering electrostatically to photoconductive surface 12. In this manner, the pre-conditioned toner powder image will be more readily transferred from the electrostatic latent image recorded on photoconductive surface 12 to support material 54 secured releasably on transfer roll 58. Transfer roll 58 recirculates support material 54 and is electrically biased to a potential of sufficient magnitude and polarity to attract electrostatically the preconditioned toner particles from the latent image recorded on photoconductive surface 12 to support material 54. Transfer roll 58 rotates in the direction of arrow 60, in synchronism with drum 10. This rotates support material 54 in registration with the toner powder image developed on photoconductive surface 12. In this manner, successive toner powder images may be transferred to support material 54, in superimposed registration with one another. U.S. Pat. No. 3,838,918 issued to Fisher in 1974 discloses a suitable transfer system.

Prior to proceeding with the remaining processing stations, the sheet feeding apparatus will be briefly described. Support material 54 is advanced from a stack 62 mounted on a tray 64. Feed roll 66, in operative communication with retard roll 68, advances and separates the uppermost sheet from stack 62. The advancing sheet moves into chute 70 which directs it into the nip between register rolls 72. Register rolls 72 align and forward the sheet to gripper fingers 74 which secure support material 54 releasably on transfer roll 58. After the requisite number of toner powder images have been transferred to support material 54, gripper fingers 74 release support material 54 and space it from transfer roll 58. As transfer roll 58 continues to rotate in the direction of arrow 60, stripper bar 76 is interposed therebetween. Support material 54 passes over stripper bar 76 onto endless belt conveyor 78. Endless belt conveyor 78 advances support material 53 to fixing station E.

At fixing station E, a fuser, indicated generally by the reference numeral 80, generates sufficient heat to permanently affix the multi-layered powder image to support material 54. A suitable fusing device is described in U.S. Pat. No. 3,781,516 issued to Tsilibes et al. in 1973. After the fusing process, support material 54 is advanced by endless belt conveyors 82 and 84 to catch tray 86 permitting the machine operator to remove the finished color copy from the printing machine.

Although a preponderance of the toner particles are transferred to support material 54 from photoconductive surface 12, invariably some residual toner particles remain adhering to photoconductive surface 12 after the transfer process. These residual toner particles are removed from photoconductive surface 12 at cleaning station F. Cleaning station F includes a corona generating device (not shown) for neutralizing the electrostatic charge remaining on the residual toner particles and photoconductive surface 12. The neutralized toner particles are then cleaned from photoconductive surface 12 by a rotatably mounted fibrous brush 88 in contact therewith. A suitable brush cleaning device is described in U.S. Pat. No. 3,590,412 issued to Gerbasi in 1971.

It is believed that the foregoing description is sufficient for purposes of the present application to illustrate the general operation of the color electrophotographic printing machine incorporating the features of the present invention therein.

Figure 2:
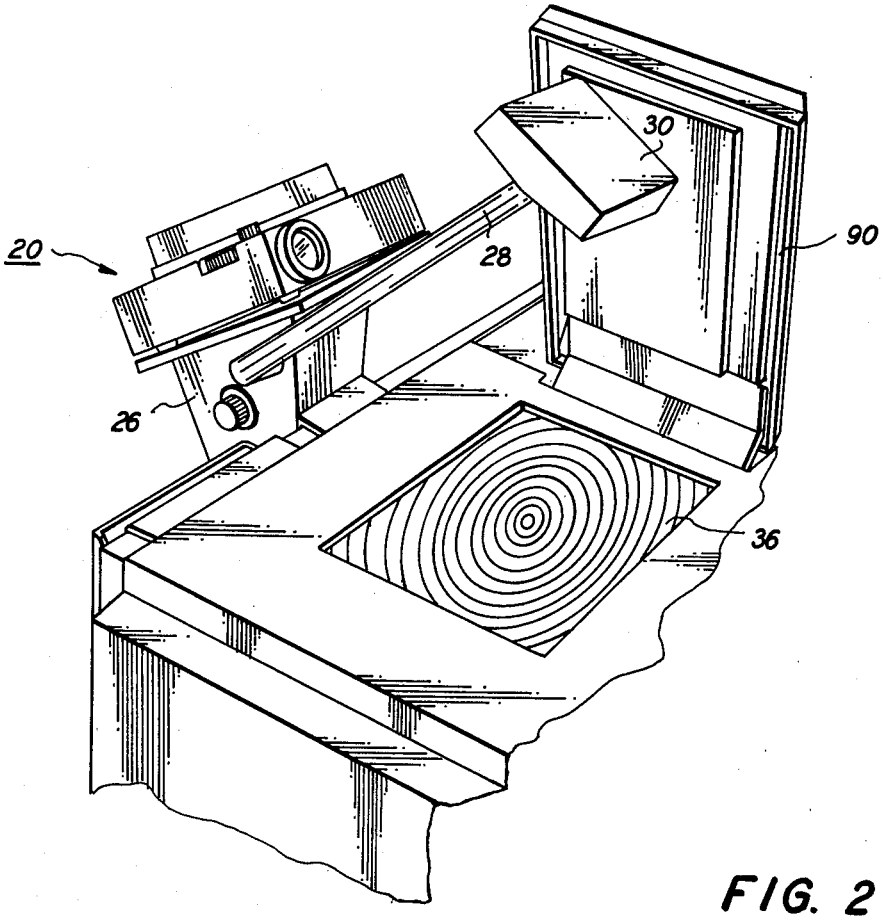
FIG. 2 is a schematic perspective view of the FIG. 1 printing machine platen assembly.

Referring now to FIG. 2, the specific characteristics of the platen employed in the FIG. 1 printing machine will be discussed hereinafter. As previously indicated, projector 20 is preferably a Kodak Carousel 600 projector having an F/3.5 Ektaner C projection lens. Projector 20 is mounted on frame 26 of the printing machine. Arm 28 is mounted pivotably on frame 26 and has mirror 30 secured rotatably on one end portion thereof. In the transparency reproduction mode, arm 28 is pivoted so as to dispose mirror 30 in the path of the transparency light image. Mirror 30 is rotated on arm 28 so that the light image is reflected in a downwardly direction through platen 36. Preferably, platen 36 is a field lens, i.e., a Fresnel lens, comprising a plurality of small light deflecting elements that provide a uniform distribution of light over a pre-determined area. One type of suitable field lens may have 200 or more gratings per inch. This field lens converges the diverging light rays from slide projector 20. This insures that the light rays transmitted onto the charged portion of photoconductive surface 12 are converging with one another. Many other types of flat field lenses may be employed in lieu of a Fresnel lens, provided they converge the diverging light rays emitted from slide projector 20. For example, the Fresnel lens may be cylindrical, circular, crossed cylindrical, crossed cylindrical and circular, or circular of two different powers. In addition, the Fresnel lens may have a frequency other than 200 gratings per inch. When a transparency is being reproduced, cover 90 is pivoted to the opened position. Contrawise, when an opaque original document is disposed on platen 36, arm 28 is pivoted to dispose mirror 30 in a position remote from cover 90. This enables cover 90 to be pivoted in a downward direction, i.e., to a closed position in engagement with the original document disposed on platen 36. Field lens or platen 36 is disposed in an aperture in the printing machine frame. The printing machine frame is substantially rigid and preferably made from a sheet metal. By way of example, field lens 36 is substantially planar and rectangular.

In general, the field lens platen may be employed in any flat platen, electrophotographic printing machine, i.e., both black and white or color copiers. The field lens platen need not be only employed for pictorial copying, it may be used for any other type of original documents, i.e., line copiers, graphs, typed sheets, etc. Moreover, the light image need not be modulated by a screen for the field lens to be operational. The field lens functions irrespective of whether or not a screen is employed in the printing machine. The field lens must be designed to match the optical characteristics of the exposure system employed in the printing machine. However, the field lens may be employed for both a stationary optical system, i.e., lens, or moving optical system. Hence, it is evident that the field lens has little or no effect on printing machine performance when an opaque original document is being reproduced, while it is necessary to converge the diverging light rays when a transparency is being reproduced.

Figure 3:
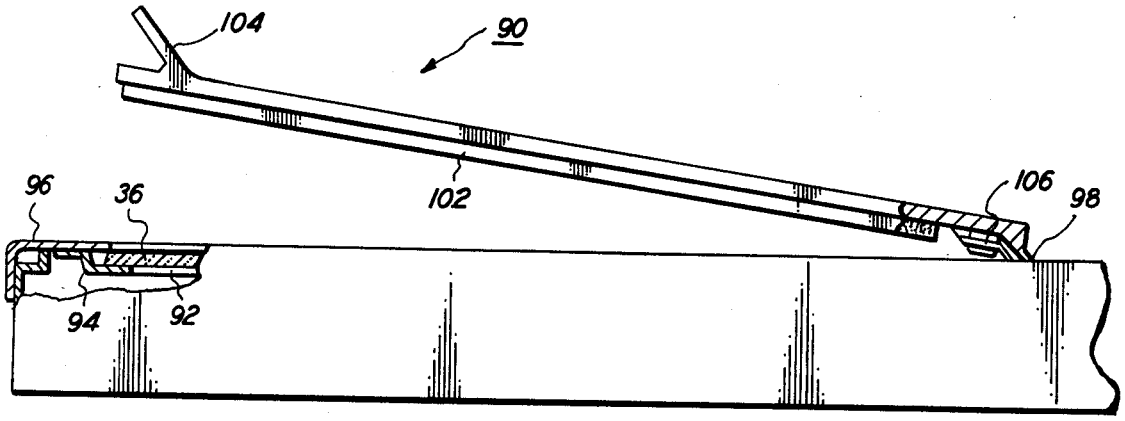
FIG. 3 is an elevational view, partially in section, depicting the FIG. 2 platen and cover assembly.

Turning now to FIG. 3, there is shown the detailed support structure for platen 36. As previously noted, platen 36 is preferably a rectangular field lens which is secured by suitable means to the frame of the electrophotographic printing machine. Field lens 36 rests upon a resilient or soft edge gasket 92 which is secured to a horizontally dependent flange 94 of the rigid machine frame. A cover plate 96, affixed to the machine frame, is placed thereover and provided with an opening therein to expose the top surface of platen 36. Platen cover 90 is mounted pivotably in region 98 of plate 96. Cover 90 includes a substantially rigid continuous outer shell 100 having affixed thereto a resilient sheet member 102 made of an elastomeric material such as soft rubber-like backing. Resilient sheet 102 may be fabricated either from a natural rubber or any number of commercially available synthetic rubbers, e.g., foam polyurethane, which is affixed to outer shell 100 by means of a suitable adhesive. A handle 104 is provided at the free end of cover 90 and provides a means by which cover 90 can be raised and lowered. To permit cover member 90 to be raised over large objects being reproduced, such as books, while still permitting cover 90 to lie in a plane substantially parallel to platen 36, cover 90 is double hinged. Double hinge 106 is secured to cover member 90 at the end thereof opposed from handle 104. A suitable double hinge is described in U.S. Pat. No. 3,062,110 issued to Shepardson et al. in 1962.

In recapitulation, the electrophotographic printing machine depicted in FIG. 1 is adapted to reproduce opaque original documents as well as transparencies. The foregoing is achieved by employing a field lens as a platen. Thus, when a transparency is being reproduced, the light image thereof is projected through the platen, i.e., the field lens. Contrawise, when an opaque original document is being reproduced, the original document is disposed face down upon the field lens. In this way, both transparencies and opaque original documents may be readily reproduced in the electrophotographic printing machine.

Thus, it is apparent that there has been provided, in accordance with the present invention, an electrophotographic printing machine that fully satisfies the objects, aims and advantages hereinbefore set forth. While this invention has been discussed in conjunction with a specific embodiment thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. An electrophotographic printing machine, including:

a photoconductive member;

means for charging at least a portion of said photoconductive member to a substantially uniform level;

means for illuminating an opaque original document;

a field lens having the opaque original document disposed thereon in a light receiving relationship with light rays transmitted from said illuminating means; and means for forming a light image of the opaque original document and irradiating the charged portion of said photoconductive member therewith to record thereon an electrostatic latent image of the original document.

2. An apparatus for transmitting a transparency light image or for holding an original document, including:

a substantially rigid frame member having an aperture therein;

a field lens mounted in the aperture of said frame member, said field lens being arranged to support the original document thereon when the transparency light image is not being transmitted therethrough and being arranged to transmit the transparency light image therethrough when the original document is not disposed thereon; and a cover member mounted movably on said frame member, said cover member being mounted movably from an opened position permitting the original document to be disposed on said field lens or the transparency to be copied and to a closed position securing releasably thereon the original document.

3. An apparatus as recited in claim 2, wherein said cover member includes:

a substantially rigid outer shell; and a resilient sheet member secured to said outer shell, said resilient sheet member being positioned to contact the original document disposed on said field lens in the closed position.

4. An apparatus as recited in claim 3, further including resilient means secured to said frame member on the periphery of the aperture therein with said field lens being mounted on said resilient means in the aperture of said frame member.

5. An apparatus as recited in claim 2, wherein said field lens includes preferably 200 gratings per inch.

6. An electrophotographic printing machine for reproducing an opaque original document or a transparency, including:

a photoconductive member;

means for charging at least a portion of said photoconductive member to a substantially uniform level;

means for illuminating the opaque original document;

a field lens arranged to support the opaque original document in a light receiving relationship with light rays transmitted from said illuminating means;

a substantially rigid frame member having an aperture therein, said frame member being mounted in the aperture of the printing machine;

resilient means secured to said frame member on the periphery of the aperture therein with said field lens being mounted on said resilient means in the aperture of said frame member;

means for forming a light image of the opaque original document and irradiating the charged portion of said photoconductive member therewith to record thereon an electrostatic latent image of the original document;

means for projecting a light image of the transparency through said field lens onto the charged portion of said photoconductive member to record thereon an electrostatic latent image of the transparency, said projecting means being inoperative during the reproduction of the original document;

means for modulating the light image of the transparency; and a composition frame disposed on said field lens in a light receiving relationship with said illuminating means when said projecting means is operative, said forming means exposing the charged portion of said photoconductive member to a light image of said composition frame recording thereon a combined electrostatic latent image comprising the electrostatic latent image of the transparency and the electrostatic latent image of said composition frame.

7. A printing machine as recited in claim 6, further including a cover member mounted movably on said frame member, said cover member being mounted movably from an opened position permitting the original document to be disposed on said field lens or the transparency to be copied and to a closed position securing releasably thereon the original document.

8. A printing machine as recited in claim 7, wherein said cover member includes:

a substantially rigid outer shell; and a resilient sheet member secured to said outer shell, said resilient sheet member being positioned to contact said composition frame disposed on said field lens in the closed position.

9. A printing machine as recited in claim 6, wherein said field lens includes preferably 200 gratings per inch.

10. A printing machine as recited in claim 6, wherein said projecting means includes a slide projector arranged to project a light image of the transparency through said field lens.

11. A printing machine as recited in claim 10, wherein said modulating means includes a screen interposed between said field lens and said composition frame.

12. A printing machine as recited in claim 11, wherein said forming means includes a lens.

13. A printing machine as recited in claim 12, wherein said screen member includes a plurality of spaced, soft gray square dots.

14. A printing machine as recited in claim 13, wherein said screen member preferably includes 85 dots per inch.

15. A printing machine as recited in claim 14, further including means for filtering the light image of the original document to form a single color light image which irradiates the charged portion of said photoconductive member to record thereon a single color electrostatic latent image.

16. A printing machine as recited in claim 15, further including:

means for developing the single color electrostatic latent image recorded on said photoconductive member with toner particles complementary in color to the color of the single color light image;

means for transferring the toner powder image from the electrostatic latent image recorded on said photoconductive member to a sheet of support material; and means for permanently affixing the toner powder image to the sheet of support material.

* * * * *